US008842063B2

(12) United States Patent
Hou

(10) Patent No.: US 8,842,063 B2
(45) Date of Patent: Sep. 23, 2014

(54) DRIVING METHOD OF LIQUID CRYSTAL DISPLAY HAVING DIFFERENT SCAN VOLTAGES

(75) Inventor: Hung-lung Hou, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 183 days.

(21) Appl. No.: 13/379,902

(22) PCT Filed: Nov. 23, 2011

(86) PCT No.: PCT/CN2011/082746

§ 371 (c)(1),
(2), (4) Date: Dec. 21, 2011

(87) PCT Pub. No.: WO2013/071580

PCT Pub. Date: May 23, 2013

(65) Prior Publication Data

US 2013/0120335 A1 May 16, 2013

(30) Foreign Application Priority Data

Nov. 16, 2011 (CN) ..... 2011 1 0363744

(51) Int. Cl.
*G09G 3/36* (2006.01)

(52) U.S. Cl.
CPC ..... *G09G 3/3648* (2013.01); *G09G 2320/0252* (2013.01); *G09G 2320/0242* (2013.01); *G09G 2320/0219* (2013.01)
USPC ..... 345/94; 345/95; 345/96

(58) Field of Classification Search
USPC ..... 345/94–96
See application file for complete search history.

(56) References Cited

U.S. PATENT DOCUMENTS

| | | | | |
|---|---|---|---|---|
| 2007/0279360 | A1* | 12/2007 | Park et al. | 345/94 |
| 2008/0198110 | A1* | 8/2008 | Sasaki | 345/87 |
| 2010/0315322 | A1* | 12/2010 | Cheng et al. | 345/99 |
| 2011/0037760 | A1* | 2/2011 | Kim et al. | 345/214 |

* cited by examiner

*Primary Examiner* — Long D Pham
(74) *Attorney, Agent, or Firm* — Ditthavong & Steiner, P.C.

(57) ABSTRACT

A LCD driving method is described. The driving method includes the steps of: (a) applying first scan voltage to first scan line for switching on first TFT, wherein data voltage of data line is transmitted to first pixel electrode via first drain electrode and first source electrode; (b) discharging first scan voltage, wherein first pixel voltage of first pixel electrode decreases first feed-through voltage; (c) applying second scan voltage to second scan line for switching on second TFT, wherein data voltage of data line is transmitted to second pixel electrode via second drain electrode and second source electrode for charging second LC capacitor in a second pixel voltage; and (d) discharging second scan voltage, wherein second pixel voltage of second pixel electrode decreases a second feed-through voltage, and first and second scan voltages are positively relative to the first and second feed-through voltages respectively.

7 Claims, 6 Drawing Sheets

DRIVING METHOD OF LIQUID CRYSTAL DISPLAY HAVING DIFFERENT SCAN VOLTAGES

FIELD OF THE INVENTION

The present invention relates to a driving method, and more particularly to a driving method of a liquid crystal display (LCD) for improving color temperature drift of the LCD by adjusting the amplitude of scanning signal from the gate electrode and for solving the problem of color shifting in the color filter on array (COA) of the LCD which results from the different response time of the three primary colors, i.e. red (R), green (G) and blue (B) colors.

BACKGROUND OF THE INVENTION

Because the LCD has the features of low radiation, small size and low power consumption, the conventional cathode ray tube (CRT) display is gradually replaced by LCD panel which is widely used in a variety of products including notebook computer, personal digital assistant (PDA), flat television and mobile phone etc.

FIG. 1 is a schematic relationship view between scan signal and data signal when performing a conventional LCD driving method. The action principle of LCD is that the data signal is recorded (written) into the liquid crystal molecules based on the scan signal 100 of the gate electrode to generate the display signals. Conventionally, the scan signal is transmitted from top to bottom in the display frame of LCD panel wherein the waveform height (Vgh) and the waveform width (GPW) maintain the same level during the transmission. That is, the same waveform height (Vgh) represents that the waveform height (Vgh) has the constant duty duration of voltage level and the waveform width (GPW) has the constant time period.

The color filter layer having red, green and blue colors is disposed in each pixel unit and the pixel regions corresponding to the red, green and blue colors are termed as sub-pixel. When performing color tracking, i.e. color temperature detection, on the LCD in the prior art, the white color tends to blue if color temperature is higher and the white color tends to yellow if color temperature is lower. The reason is that three primary colors, i.e. red (R), green (G) and blue (B) colors are inconsistent. That is, the RGB primary color cannot form a predetermined color ratio based on the data signal so that voltage-transmittance curves of RGB primary color are different. Such the situation results in color ratio deviation of RGB primary color in different gray levels, i.e. color shifting, when the same gray level is applied to the LCD panel. A manufacturing procedure is used to solve the above problem. The RGB colors have different liquid crystal height to change the voltage and transmittance thereof for compensating the voltage-transmittance curve. However, the manufacturing procedure easily deviates due to operation conditions, which cannot improve the color shifting.

Additionally, since the material characteristic of color-resisting layer of color filter in the COA is varied, different dielectric constant of three primary color RGB, the capacitance (Cgs) between the gate electrode and pixel electrode is different so that the feed-through voltages of RGB change and thus the response time of the three primary color RGB varies, i.e. the color shifting, in the same gray level.

Consequently, there is a need to develop a driving method of LCD to solve the aforementioned problem of the color temperature deviation and response time inconsistence of the three primary color RGB.

SUMMARY OF THE INVENTION

One objective of the present invention is to provide a driving method of a liquid crystal display (LCD) for improving color temperature drift of the LCD by adjusting the amplitude of scanning signal from the gate electrode and for solving the problem of color shifting in the color filter on array (COA) of the LCD which results from the different response time of the three primary colors.

According to the above objective, the present invention sets forth a driving method of LCD. A plurality of scan lines having a first scan line and a second scan line are insulatedly interlaced with and a plurality of data lines to form a plurality of sub-pixel regions having a first sub-pixel region and a second sub-pixel region, the first sub-pixel region has a first thin film transistor (TFT), a first pixel electrode and a common electrode, the second sub-pixel region has a second TFT, a second pixel electrode and the common electrode, the first TFT comprises a first gate electrode coupled to the first scan line, a first source electrode coupled to the first pixel electrode and a first drain electrode coupled to a data line, the second TFT comprises a second gate electrode coupled to the second scan line, a second source electrode coupled to the second pixel electrode and a second drain electrode coupled to the data line, and the first pixel electrode and the second pixel electrode overlapped with the common electrode respectively form a first liquid crystal (LC) capacitor and a second LC capacitor, the driving method comprising the steps of:

(a) applying a first scan voltage to the first scan line for switching on the first TFT, wherein the data voltage of the data line is transmitted to the first pixel electrode via the first drain electrode and the first source electrode for charging the first LC capacitor in a first pixel voltage;

(b) discharging the first scan voltage from the first TFT for switching off the first TFT, wherein the first pixel voltage of the first pixel electrode decreases a first feed-through voltage;

(c) applying a second scan voltage to the second scan line for switching on the second TFT, wherein the data voltage of the data line is transmitted to the second pixel electrode via the second drain electrode and the second source electrode for charging the second LC capacitor in a second pixel voltage, and the first scan voltage is different from the second scan voltage; and (d) discharging the second scan voltage from the second TFT for switching off the second TFT, wherein the second pixel voltage of the second pixel electrode decreases a second feed-through voltage, and first scan voltage and the second scan voltage are positively relative to the first feed-through voltage and the second feed-through voltage, respectively.

In one embodiment, the scan lines further comprise a third scan line, the sub-pixel regions further comprise a third sub-pixel region having a third TFT, a third pixel electrode and the common electrode, the third TFT has a third gate electrode coupled to the third scan line, a third source electrode coupled to the third pixel electrode and a third drain electrode coupled to the data line, and the third pixel electrode overlapped with the common electrode forms a third LC capacitor, after the step (d), further comprising the steps of:

(e) applying a third scan voltage to the third scan line for switching on the third TFT, wherein the data voltage of the data line is transmitted to the third pixel electrode via the third drain electrode and the third source electrode for charging the third LC capacitor in a third pixel voltage, and the first scan voltage, the second scan voltage and the third scan voltage are different; and (f) discharging the third scan voltage from the third TFT for switching off the third TFT, wherein the third pixel voltage of the third pixel electrode decreases a third feed-through voltage, and the third scan voltage is positively relative to the third feed-through voltage.

In one embodiment, the first feed-through voltage, the second feed-through voltage and the third feed-through voltage are represented as the following formulas respectively:

$$\Delta V1=Cgs1*Vpp1/(Clc1+Cst+Cgs1);$$

$$\Delta V2=Cgs2*Vpp2/(Clc2+Cst+Cgs2); \text{ and}$$

$$\Delta V3=Cgs3*Vpp3/(Clc3+Cst+Cgs3);$$

wherein ΔV1, ΔV2 and ΔV3 are the first, second and third feed-through voltages respectively; Cgs1 is a first capacitance formed by the first gate electrode and the second source electrode, Cgs2 is a second capacitance formed by the second gate electrode and the second source electrode and Cgs3 is a third capacitance formed by the third gate electrode and the third source electrode; Vpp1, Vpp2 and Vpp3 are the first, second and third scan voltages respectively; Clc1, Clc2 and Clc3 are the first, second and third LC capacitors respectively; and Cst is the storage capacitor of the sub-pixel region.

In one embodiment, when Cgs1>Cgs2>Cgs3, the first, second and third scan voltages are adjusted respectively for forming the following formulas: Vpp1<Vpp2<Vpp3, and ΔV1=ΔV2=ΔV3.

In one embodiment, the voltage of the first drain electrode is greater than the voltage of the second drain electrode, and the voltage of the second drain electrode is greater than the voltage of the third drain electrode.

In one embodiment, when Cgs1=Cgs2=Cgs3 and a predetermined data voltage is applied to the first sub-pixel region corresponding to a first transmittance, the second sub-pixel region corresponding to a second transmittance and the third sub-pixel region corresponding to a third transmittance respectively, the first, second and third scan voltages are adjusted respectively for forming the following formulas: Vpp1>Vpp2>Vpp3, and ΔV1>ΔV2>ΔV3.

In one embodiment, the first, second and third sub-pixel regions are a red (R) sub-pixel, a green (G) sub-pixel and a blue (B) sub-pixel.

The driving method of LCD improves color temperature drift of the LCD for solving the problem of color shifting in the color filter on array (COA) of the LCD which results from the different response time of the three primary colors.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
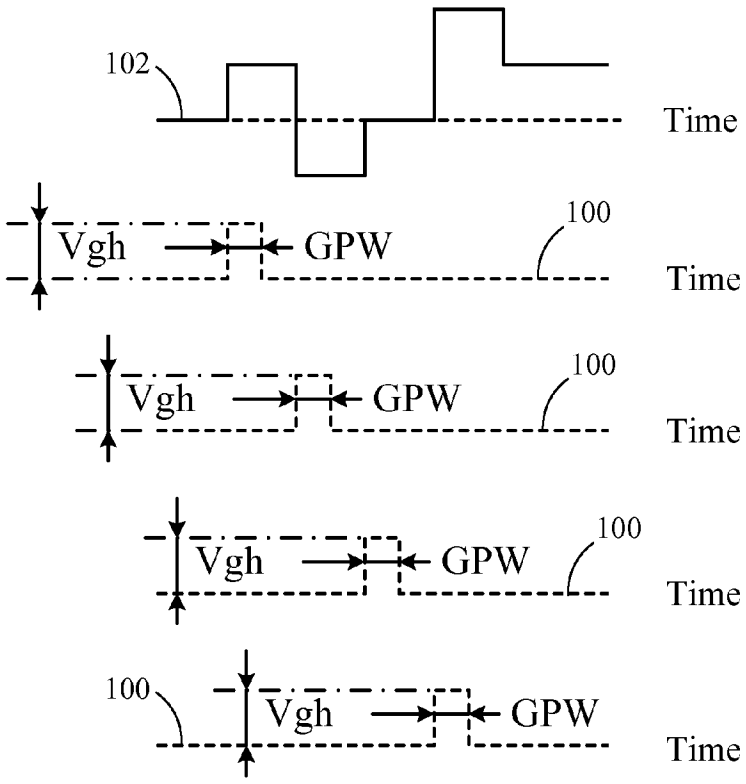
FIG. 1 (Prior Art)
FIG. 1 is a schematic relationship view between scan signal and data signal when performing a conventional LCD driving method.
Figure 2:
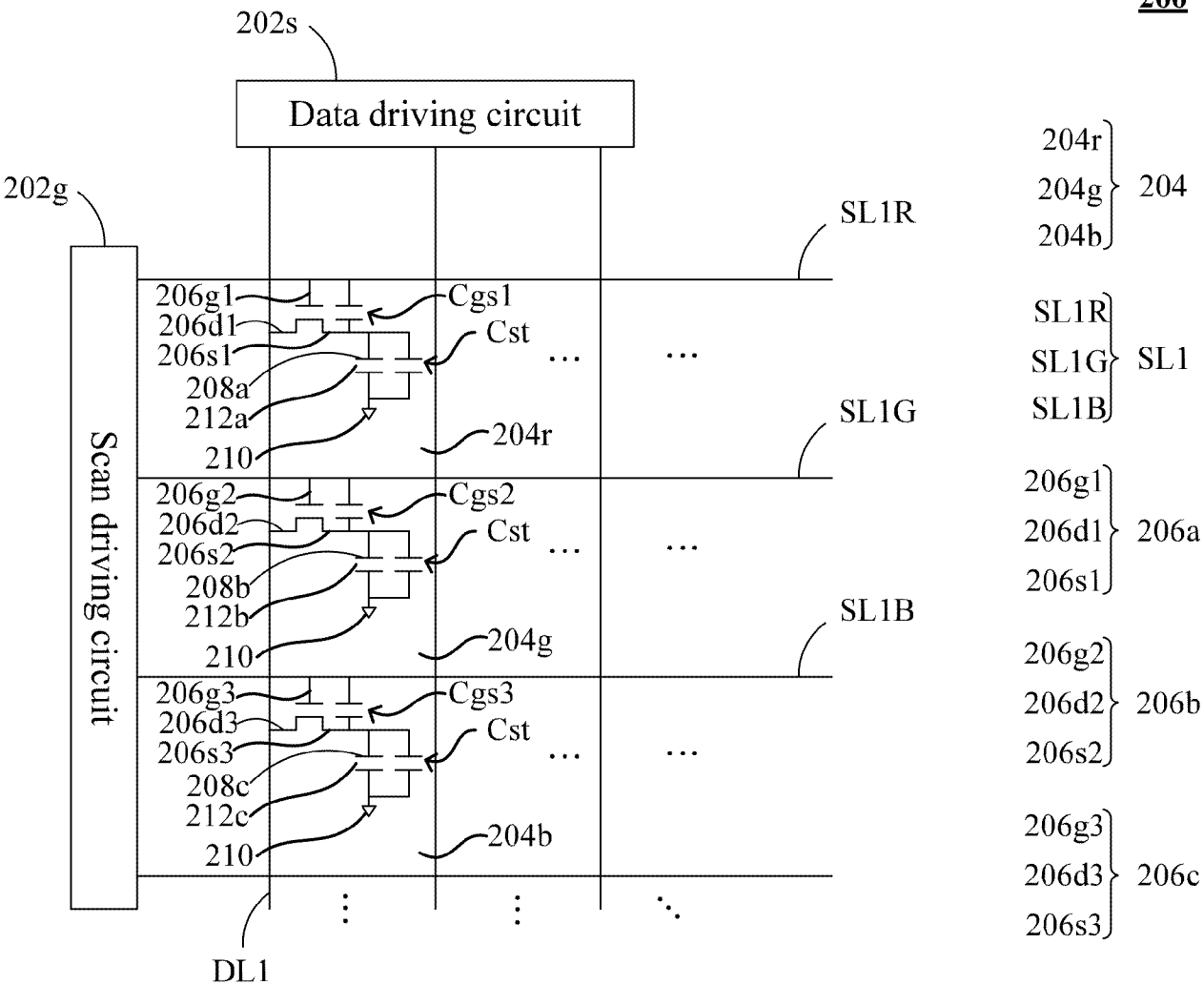
FIG. 2 is a schematic LCD driving circuit according to one embodiment of the present invention.

FIG. 2 is a schematic driving circuit of LCD panel 200 according to one embodiment of the present invention. The LCD panel 200 includes a scan driving circuit 202*g*, a data driving circuit 202*s*, a plurality of scan lines SL1, a plurality of data lines DL1 and a plurality of pixel units 204. The scan driving circuit 202*g* connects to the scan lines SL1 and the data driving circuit 202*s* connects to the data lines DL1. The scan lines SL1 are insulatedly interlaced with the data lines DL1 to form the pixel units 204 and each pixel unit 204 has a sub-pixel region. The scan driving circuit 202*g* supplies the pixel units 204 with scan voltage. The data driving circuit 202*s* provides the data voltage for the sub-pixel regions of the pixel units 204 based on the scan voltage.

As shown in FIG. 2, the scan lines SL1 are interlaced with the data lines DL1 to from the sub-pixel regions. The scan lines having a first scan line SL1R, a second scan line SL1G and a third scan line SL1B. The sub-pixel regions include a first sub-pixel region 204*r*, a second sub-pixel region 204*g* and a third sub-pixel region 204*b*. The first sub-pixel region 204*r* has a first thin film transistor (TFT) 206*a*, a first pixel electrode 208*a*, a common electrode (Vcom) 210 and a storage capacitor Cst. The second sub-pixel region 204*g* has a second thin film transistor (TFT) 206*b*, a second pixel electrode 208*b*, the common electrode (Vcom) 210 and a storage capacitor Cst. The third sub-pixel region 204*b* has a third thin film transistor (TFT) 206*c*, a third pixel electrode 208*c*, the common electrode (Vcom) 210 and a storage capacitor Cst.

The first TFT 206*a* includes a first gate electrode 206*g*1 coupled to the first scan line SL1R, a first source electrode 206*s*1 coupled to the first pixel electrode 208*a* and a first drain electrode 206*d*1 coupled to a data line DL1. The second TFT 206*b* includes a second gate electrode 206*g*2 coupled to the second scan line SL1G, a second source electrode 206*s*2 coupled to the second pixel electrode 208*b* and a second drain electrode 206*d*2 coupled to the data line DL1. The third TFT 206*c* includes a third gate electrode 206*g*3 coupled to the third scan line SL1B, a third source electrode 206*s*3 coupled to the third pixel electrode 208*c* and a third drain electrode 206*d*3 coupled to the data line DL1. The first pixel electrode 208*a*, the second pixel electrode 208*b* and the third pixel electrode 208*c* are overlapped with the common electrode 210 respectively to form a first liquid crystal (LC) capacitor 212*a*, a second LC capacitor 212*b* and a third LC capacitor 212*c*.

When the first scan line SL1R, the second scan line SL1G and the third scan line SL1B provides the scan voltage for the first TFT 206*a* coupled to the first scan line SL1R, the second TFT 206*b* coupled to the second scan line SL1G, and the third TFT 206*c* coupled to the third scan line SL1B respectively, the data (i.e. voltage level) is recorded into the first pixel electrode 208*a*, the second pixel electrode 208*b* and the third pixel electrode 208*c* respectively.

After the data are written into the pixel electrodes, the first TFT 206*a*, the second TFT 206*b* and the third TFT 206*c* are switched off and the liquid crystal capacitor (Clc) and storage capacitor (Cst) maintains the voltage level in the first pixel electrode 208*a*, the second pixel electrode 208*b* and the third pixel electrode 208*c* respectively. Basically, when the first pixel electrode 208*a*, the second pixel electrode 208*b* and the third pixel electrode 208*c* respectively are switched off, the voltage level of the pixel electrode is affected by adjacent pixel unit and thus the voltage level is varied wherein the varied voltage level is defined as feed-through voltage (VFT). Furthermore, in the action principle of LCD, an electrical field is applied to the liquid crystal molecules to change the rotation angle of the liquid crystal molecules for generating the different gray levels. Because the magnitude of the electrical field applied to the liquid crystal molecules is determined by the voltage difference between the pixel electrode and common electrode in the sub-pixel region, therefore, the feed-through voltage (VFT) can be changed to adjust the voltage level of the pixel electrode in the sub-pixel region for changing the rotation angle of the liquid crystal molecules.

In one embodiment, the first sub-pixel region 204*r*, the second sub-pixel region 204*g* and the third sub-pixel region sub-pixel region 204*b* are a red (R) sub-pixel, a green (G) sub-pixel and a blue (B) sub-pixel.

Figure 3:
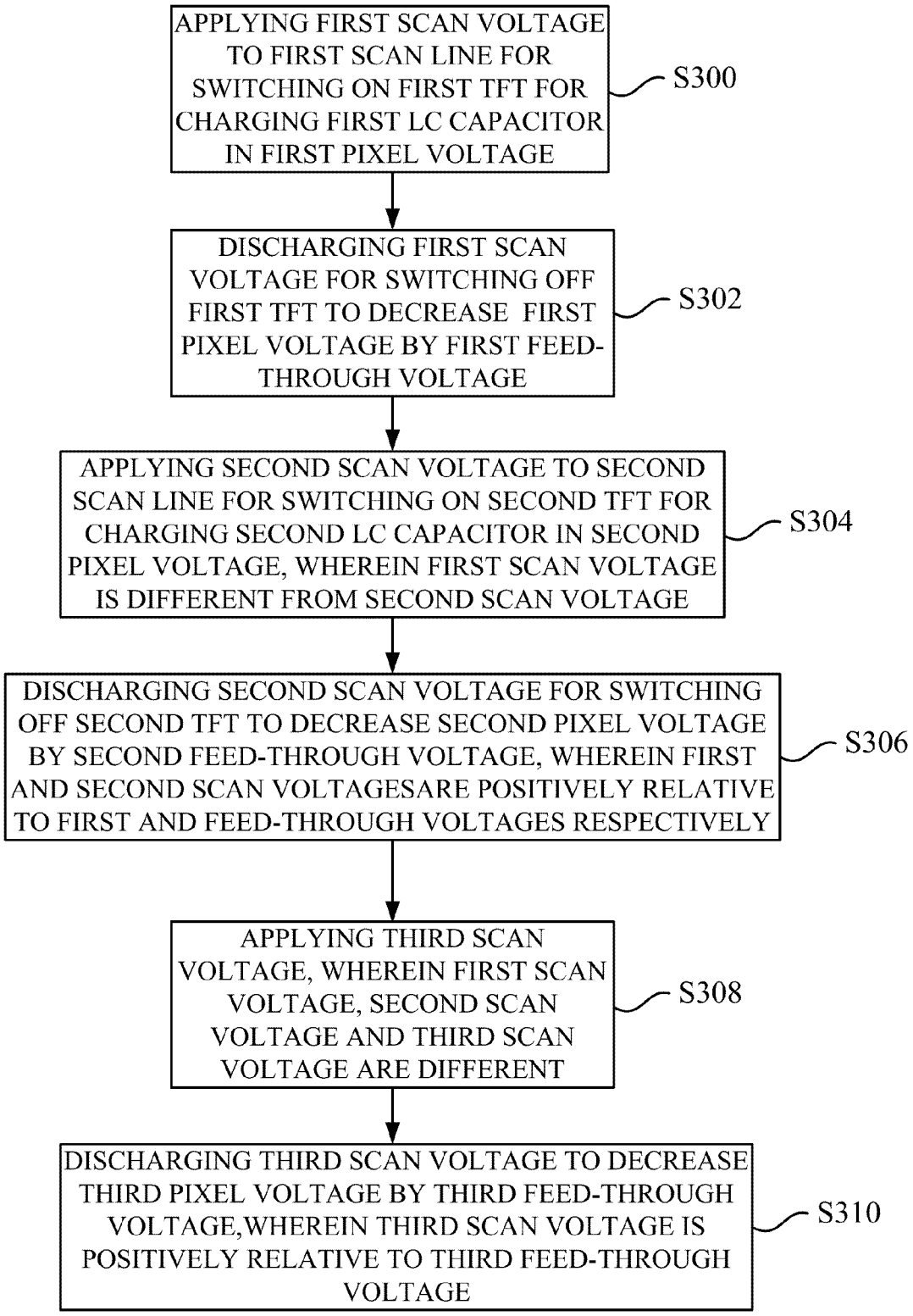
FIG. 3 is a flow chart of LCD driving method according to one embodiment of the present invention.

FIG. 3 is a flow chart of driving method of LCD panel 200 according to one embodiment of the present invention. Based on the driving circuit of LCD panel 200 shown in FIG. 2, the driving method in FIG. 3 includes the following steps.

In steps S300, a first scan voltage s applied to the first scan line SL1R for switching on the first TFT 206*a*, wherein the data voltage of the data line DL1 is transmitted to the first pixel electrode 208*a* via the first drain electrode 206*d*1 and the first source electrode 206*s*1 for charging the first LC capacitor 212*a* in a first pixel voltage.

In steps S302, the first scan voltage is discharged from the first TFT 206*a* for switching off the first TFT 206*a*, wherein the first pixel voltage of the first pixel electrode decreases a first feed-through voltage.

In steps S304, a second scan voltage is applied to the second scan line SL1G for switching on the second TFT 206*b*, wherein the data voltage of the data line DL1 is transmitted to the second pixel electrode 208*b* via the second drain electrode 206*d*2 and the second source electrode 206*s*2 for charging the second LC capacitor 212*b* in a second pixel voltage, and the first scan voltage is different from the second scan voltage.

In steps S306, the second scan voltage is discharged from the second TFT 206*b* for switching off the second TFT 206*b*, wherein the second pixel voltage of the second pixel electrode 208*b* decreases a second feed-through voltage, and first scan voltage and the second scan voltage are positively relative to the first feed-through voltage and the second feed-through voltage, respectively.

In steps S308, a third scan voltage is applied to the third scan line for switching on the third TFT 206*c*, wherein the data voltage of the data line DL1 is transmitted to the third pixel electrode 208*c* via the third drain electrode 206*d*3 and the third source electrode 206*s*3 for charging the third LC capacitor 212*c* in a third pixel voltage, and the first scan voltage, the second scan voltage and the third scan voltage are different.

In steps S310, the third scan voltage is discharged from the third TFT 206*c* for switching off the third TFT 206*c*, wherein the third pixel voltage of the third pixel electrode 208*c* decreases a third feed-through voltage, and the third scan voltage is positively relative to the third feed-through voltage.

The first feed-through voltage, the second feed-through voltage and the third feed-through voltage are represented as the following formulas respectively:

$$\Delta V1=Cgs1*Vpp1/(Clc1+Cst+Cgs1) \quad (E1);$$

$$\Delta V2=Cgs2*Vpp2/(Clc2+Cst+Cgs2) \quad (E2);$$

and $$\Delta V3=Cgs3*Vpp3/(Clc3+Cst+Cgs3) \quad (E3);$$

wherein ΔV1, ΔV2 and ΔV3 are the first, second and third feed-through voltages respectively; Cgs1 is a first capacitance formed by the first gate electrode and the second source electrode, Cgs2 is a second capacitance formed by the second gate electrode and the second source electrode and Cgs3 is a third capacitance formed by the third gate electrode and the third source electrode; Vpp1, Vpp2 and Vpp3 are the first, second and third scan voltages respectively; Clc1, Clc2 and Clc3 are the first LC capacitor 212*a*, the second LC capacitor 212*b* and the third LC capacitor 212*c* respectively; and Cst is the storage capacitor of the sub-pixel region.

Figure 4B:
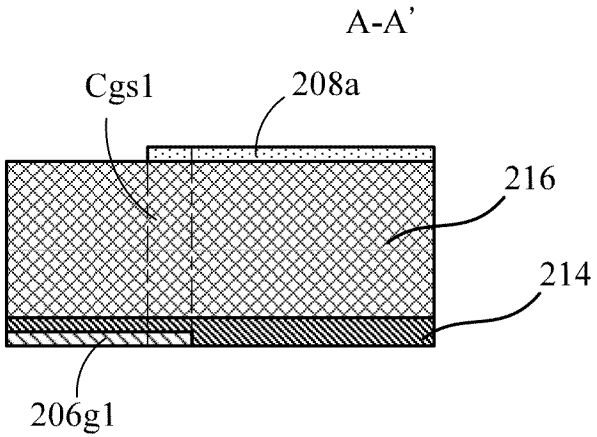
FIG. 4B is a schematic cross-sectional view of circuit layout of a sub-pixel region shown in FIG. 4A along line A-A' according to one embodiment of the present invention.
Figure 4A:
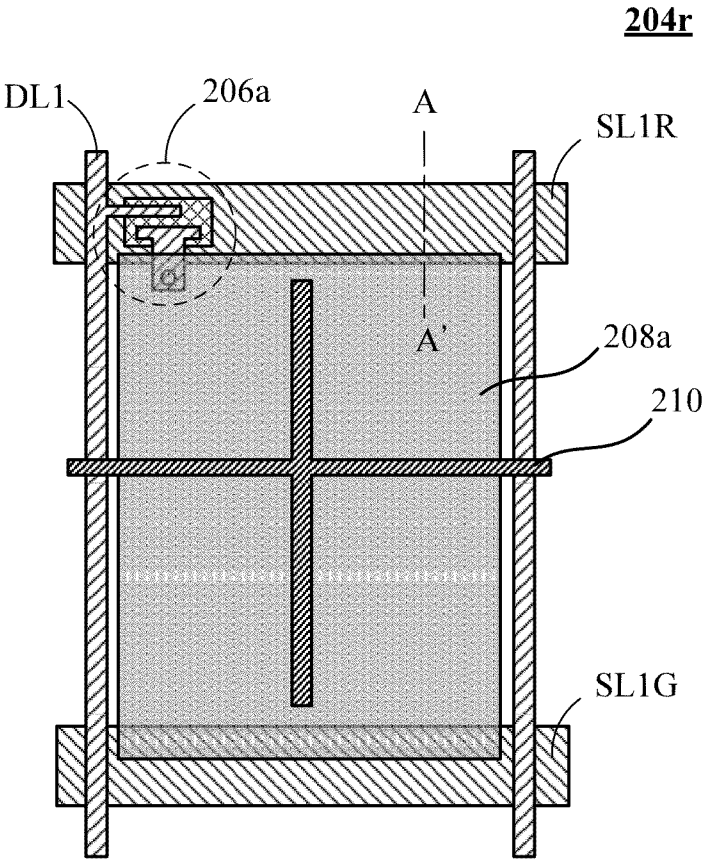
FIG. 4A is a schematic circuit layout of a sub-pixel region in a LCD panel according to a first embodiment of the present invention.

FIG. 4A is a schematic circuit layout of a sub-pixel region in a LCD panel 200 according to a first embodiment of the present invention. FIG. 4B is a schematic cross-sectional view of circuit layout of a sub-pixel region shown in FIG. 4A along line A-A' according to one embodiment of the present invention. Please also refer to driving circuit of the LCD panel 200 in FIG. 2. For an example of sub-pixel region 204*r* in the COA, the second sub-pixel region 204*r* includes a first TFT 206*a*, a first pixel electrode 208*a* and a common electrode 210 wherein a gate insulation layer 214 and color-resisting layer 216 are disposed between the first gate electrode 206*g*1 and first pixel electrode 208*a* to form the first capacitance Cgs1. Similarly, in the second sub-pixel region, the gate insulation layer 214 and color-resisting layer 216 are disposed between the second gate electrode 206*g*2 and second pixel electrode 208*b* to form the second capacitance Cgs2. Additionally, the gate insulation layer 214 and color-resisting layer 216 are disposed between the third gate electrode 206*g*3 and third pixel electrode 208*c* to form the third capacitance Cgs3. In one embodiment, Cgs is proportional to the formula: ∈*A/d, where "∈" is dielectric constant of color-resisting layer, "A" is overlapped area between the pixel electrode and gate electrode and "d" is the distance between the pixel electrode and gate electrode.

Figure 5:
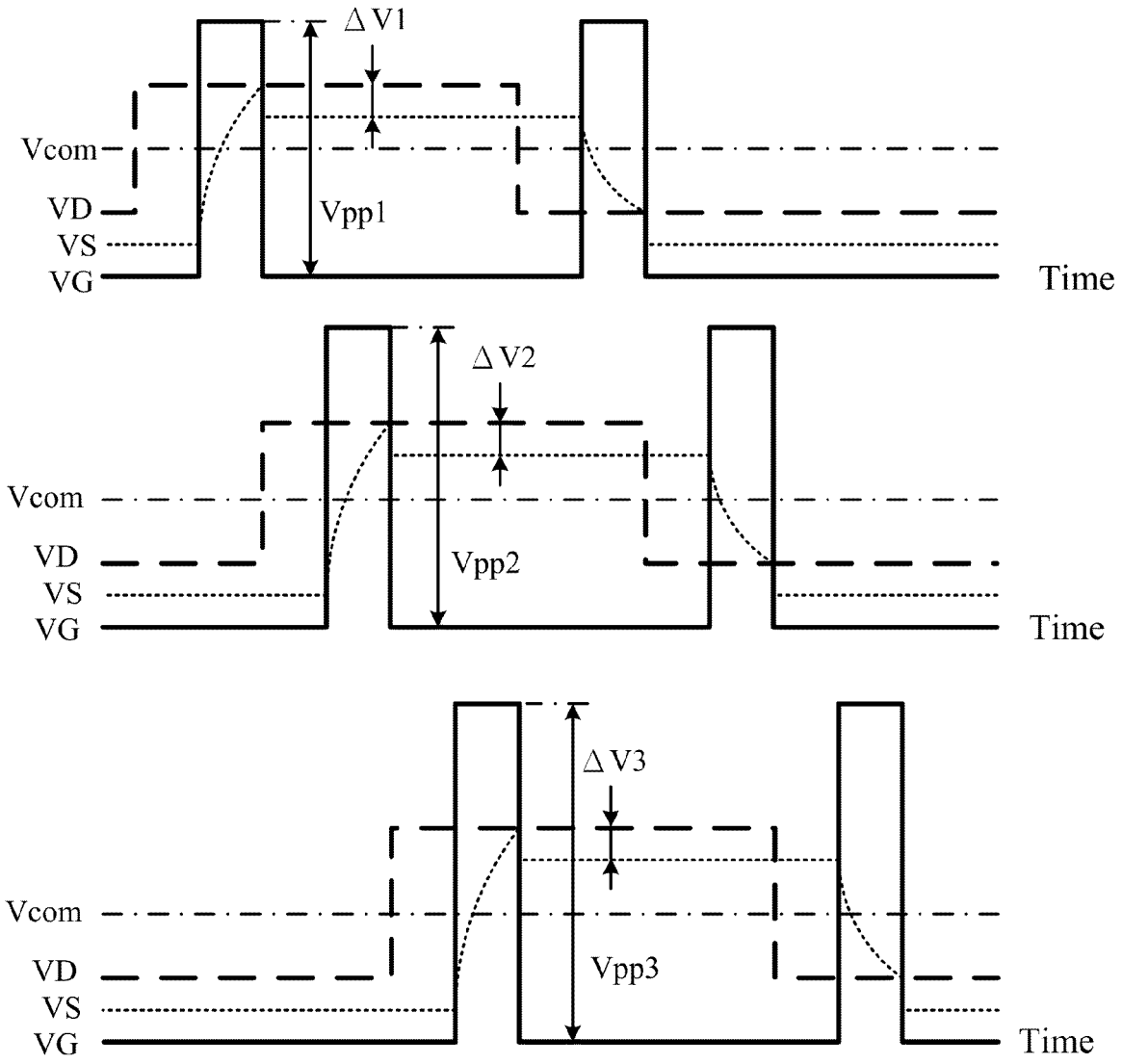
FIG. 5 is a schematic wave profile view of adjusted signal waveforms of three sub-pixel regions while performing the driving method according to the first embodiment of the present invention.

FIG. 5 is a schematic wave profile view of adjusted signal waveforms of three sub-pixel regions while performing driving method according to the first embodiment of the present invention. The horizontal axis represents time and the vertical axis is signal amplitude including scan signal VG, drain signal VD, source signal VS and common electrode signal Vcom. When applying scan voltage during the steps S300, S304 and S308 and based on the above-mentioned formulas (E1), (E2) and (E3), if Cgs1>Cgs2>Cgs3, the first, second and third scan voltages are adjusted respectively for forming the following formulas: Vpp1<Vpp2<Vpp3, and ΔV1=ΔV2=ΔV3. Specifically, when the first scan voltage, the second scan voltage and the third scan voltage are adjusted, the first drain voltage, the second drain voltage and the third drain voltage are changed correspondingly and the first scan voltage, the second scan voltage and the third scan voltage are positively relative to the first drain voltage, the second drain voltage and the third drain voltage. When the TFT switches on, the voltage level of the pixel electrode approaches to the voltage level of the source electrode. Thus, the changed scan voltages are used to adjust the feed-through voltages so that the feed-through voltage's formula, ΔV1=ΔV2=ΔV3, is true. Therefore, the voltage difference of the pixel electrode in each sub-pixel region approaches to the same voltage level so that the liquid crystal molecules is in the same gray level and the three primary colors have the same response time to solve the problem of color shifting while the liquid crystal molecules dynamically rotates at a predetermined angle.

Figure 6:
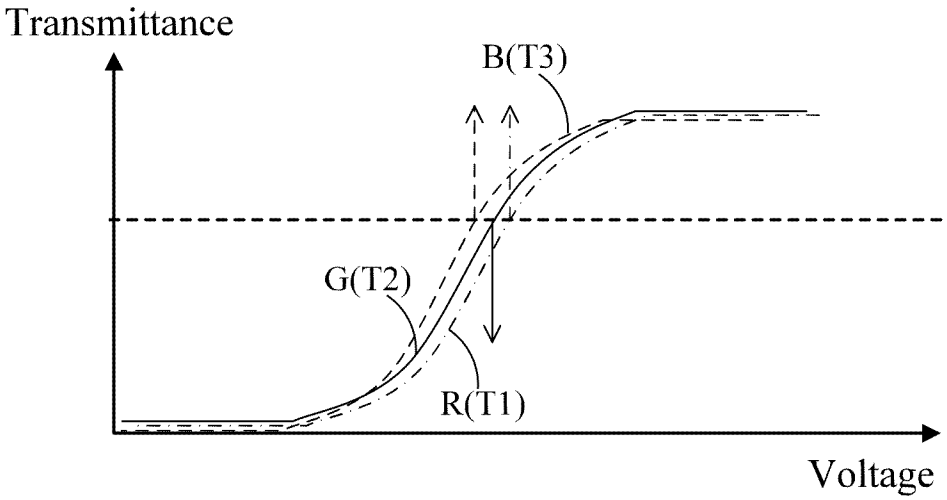
FIG. 6 is a schematic relationship view of voltage and transmittance of three sub-pixel regions according to a second embodiment of the present invention.

FIG. 6 is a schematic relationship view of voltage and transmittance of three sub-pixel regions according to a second embodiment of the present invention. The horizontal axis represents voltage and the vertical axis represents transmittance. "R" is the red sub-pixel region (first sub-pixel region), "G" is the green sub-pixel region (second sub-pixel region), and "B" is the blue sub-pixel region (third sub-pixel region). For example, a predetermined voltage V1 is applied to the red sub-pixel region "R", the green sub-pixel region "G" and the blue sub-pixel region "B", the sub-pixel regions "R", "G" and "B" corresponds to the first transmittance "T1", the second transmittance "T2" and the third transmittance "T3", respectively. In one embodiment, when the following capacitance formula, Cgs1=Cgs2=Cgs3, is true, and a predetermined voltage V1 is applied to the sub-pixel regions "R", "G" and "B" corresponding to the first transmittance "T1", the second transmittance "T2" and the third transmittance "T3", the first, second and third scan voltages (Vpp1, Vpp2 and Vpp3) are adjusted. For example, the first, second and third scan voltages are increased and Vpp1>Vpp2>Vpp3 so that (V1+ΔV1)>(V1+ΔV2)>(V1+ΔV3), i.e. ΔV1>ΔV2>ΔV3. In other words, when the first, second and third sub-pixel regions receive the same predetermined data voltage, the voltage-transmittance profiles of three primary colors RGB are inconsistency. The driving method in the present invention utilizes the scan voltage to adjust the feed-through voltage for modifying the data voltage to solve the problem of color shifting.

In another embodiment, when the following capacitance formula, Cgs1=Cgs2=Cgs3, is true, the first transmittance "T1", the second transmittance "T2" and the third transmittance "T3", the first, second and third scan voltages (Vpp1, Vpp2 and Vpp3) are adjusted, for example, the first, second and third scan voltages are increased, so that (V1+ΔV1)>V1>(V1−ΔV1) to solve the problem of color shifting.

Based on the above descriptions, the present invention utilizes a driving method of a liquid crystal display (LCD) for improving color temperature drift of the LCD by adjusting the amplitude of scanning signal from the gate electrode and for solving the problem of color shifting in the color filter on array (COA) of the LCD which results from the different response time of the three primary colors.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A driving method of liquid crystal display (LCD), wherein a plurality of scan lines having a first scan line and a second scan line are insulatedly interlaced with and a plurality of data lines to form a plurality of sub-pixel regions having a first sub-pixel region and a second sub-pixel region, the first sub-pixel region has a first thin film transistor (TFT), a first pixel electrode and a common electrode, the second sub-pixel region has a second thin film transistor (TFT), a second pixel electrode and the common electrode, the first TFT comprises a first gate electrode coupled to the first scan line, a first source electrode coupled to the first pixel electrode and a first drain electrode coupled to a data line, the second TFT comprises a second gate electrode coupled to the second scan line, a second source electrode coupled to the second pixel electrode and a second drain electrode coupled to the data line, and the first pixel electrode and the second pixel electrode overlapped with the common electrode respectively form a first liquid crystal (LC) capacitor and a second LC capacitor, the driving method comprising the steps of:

(a) applying a first scan voltage to the first scan line for switching on the first TFT, wherein the data voltage of the data line is transmitted to the first pixel electrode via the first drain electrode and the first source electrode for charging the first LC capacitor in a first pixel voltage;

(b) discharging the first scan voltage from the first TFT for switching off the first TFT, wherein the first pixel voltage of the first pixel electrode decreases a first feed-through voltage;

(c) applying a second scan voltage to the second scan line for switching on the second TFT, wherein the data voltage of the data line is transmitted to the second pixel electrode via the second drain electrode and the second source electrode for charging the second LC capacitor in a second pixel voltage, and the first scan voltage is different from the second scan voltage in form of a peak value difference; and (d) discharging the second scan voltage from the second TFT for switching off the second TFT, wherein the second pixel voltage of the second pixel electrode decreases a second feed-through voltage, and first scan voltage and the second scan voltage are positively relative to the first feed-through voltage and the second feed-through voltage, respectively, and wherein when Cgs1=Cgs2 and a predetermined data voltage is applied to the first sub-pixel region corresponding to a first transmittance and to the second sub-pixel region corresponding to a second transmittance respectively, the first and second scan voltages are adjusted respectively for forming the following formulas: Vpp1>Vpp2, and ΔV1>ΔV2, and wherein Cgs1 is a first capacitance formed by the first gate electrode and the second source electrode, Cgs2 is a second capacitance formed by the second gate electrode and the second source electrode, Vpp1 and Vpp2 are the first and second scan voltages respectively, and ΔV1 and ΔV2 are the first and second feed-through voltages respectively.

2. The driving method of claim 1, wherein the scan lines further comprise a third scan line, the sub-pixel regions further comprise a third sub-pixel region having a third TFT, a third pixel electrode and the common electrode, the third TFT has a third gate electrode coupled to the third scan line, a third source electrode coupled to the third pixel electrode and a third drain electrode coupled to the data line, and the third pixel electrode overlapped with the common electrode forms a third LC capacitor, after the step (d), further comprising the steps of:

(e) applying a third scan voltage to the third scan line for switching on the third TFT, wherein the data voltage of the data line is transmitted to the third pixel electrode via the third drain electrode and the third source electrode for charging the third LC capacitor in a third pixel voltage, and the first scan voltage, the second scan voltage and the third scan voltage are different; and (f) discharging the third scan voltage from the third TFT for switching off the third TFT, wherein the third pixel voltage of the third pixel electrode decreases a third feed-through voltage, and the third scan voltage is positively relative to the third feed-through voltage.

3. The driving method of claim 2 , wherein the first feed-through voltage, the second feed-through voltage and the third feed-through voltage are represented as the following formulas respectively:

$\Delta V1=Cgs1*Vpp1/(Clc1+Cst+Cgs1)$;

$\Delta V2=Cgs2*Vpp2/(Clc2+Cst+Cgs2)$; and $\Delta V3=Cgs3*Vpp3/(Clc3+Cst+Cgs3)$;

wherein ΔV3 is the third feed-through voltage, Cgs3 is a third capacitance formed by the third gate electrode and the third source electrode, and Vpp3 is the third scan voltages; Clc1, Clc2 and Clc3 are the first, second and third LC capacitors respectively; and Cst is the storage capacitor of the sub-pixel region.

4. The driving method of claim 3, wherein when Cgs1>Cgs2>Cgs3, the first, second and third scan voltages are adjusted respectively for forming the following formulas: Vpp1<Vpp2<Vpp3, and ΔV1=ΔV2=ΔV3.

5. The driving method of claim 4, wherein the voltage of the first drain electrode is greater than the voltage of the second drain electrode, and the voltage of the second drain electrode is greater than the voltage of the third drain electrode.

6. The driving method of claim 3, wherein when Cgs1=Cgs2=Cgs3 and the third sub-pixel region corresponding to a third transmittance, the first, second and third scan voltages are adjusted respectively for forming the following formulas: Vpp1>Vpp2>Vpp3, and ΔV1>ΔV2>ΔV3.

7. The driving method of claim 2, wherein the first, second and third sub-pixel regions are a red (R) sub-pixel, a green (G) sub-pixel and a blue (B) sub-pixel.

* * * * *